US009128405B2

(12) United States Patent
Tetsuno et al.

(10) Patent No.: US 9,128,405 B2
(45) Date of Patent: Sep. 8, 2015

(54) IMAGE FORMING APPARATUS CONTROLLING CHARGING VOLTAGE BASED ON IMAGE DENSITY INFORMATION

(71) Applicant: CANON KABUSHIKI KAISHA, Tokyo (JP)

(72) Inventors: Shuichi Tetsuno, Kawasaki (JP); Hideaki Hasegawa, Suntou-gun (JP); Takuya Kitamura, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/100,452

(22) Filed: Dec. 9, 2013

(65) Prior Publication Data

US 2014/0169815 A1 Jun. 19, 2014

(30) Foreign Application Priority Data

Dec. 14, 2012 (JP) ..... 2012-273731

(51) Int. Cl.
*G03G 15/02* (2006.01)
*G03G 15/04* (2006.01)

(52) U.S. Cl.
CPC ..... *G03G 15/0266* (2013.01); *G03G 15/04* (2013.01)

(58) Field of Classification Search
CPC ..... G03G 15/0266; G03G 15/04
USPC ..... 399/50, 51
See application file for complete search history.

(56) References Cited

U.S. PATENT DOCUMENTS

2003/0072579 A1* 4/2003 Bessho et al. ..... 399/44

FOREIGN PATENT DOCUMENTS

| | | | | |
|---|---|---|---|---|
| JP | 2000-075573 | A | | 3/2000 |
| JP | 2001-272850 | A | | 10/2001 |
| JP | 2003-043784 | A | * | 2/2003 |
| JP | 2003-186284 | A | * | 7/2003 |
| JP | 2007-171633 | A | | 7/2007 |
| JP | 2007-232881 | A | | 9/2007 |
| JP | 2008-8991 | A | | 1/2008 |
| JP | 2011-022496 | A | | 2/2011 |
| JP | 2011-180460 | A | | 9/2011 |

OTHER PUBLICATIONS

Machine translaton of JP 2008-008991 (with publication date of Feb. 14, 2003) printed on Nov. 19, 2014.*
Office Action issued in Japanese Patent Application No. 2012-273731, dated Nov. 4, 2014.

* cited by examiner

*Primary Examiner* — Sophia S Chen
(74) *Attorney, Agent, or Firm* — Fitzpatrick, Cella, Harper & Scinto

(57) ABSTRACT

An image forming apparatus includes a plurality of image forming stations and a control portion configured to control an image forming operation. Each of the image forming stations includes an image bearing member configured to form a toner image on a surface thereof and a charging device configured to charge the image bearing member. The toner images formed on the image bearing members of the image forming stations are sequentially transferred to a transfer incurring member to be superimposed. The control portion sets a voltage applied to the charging device in forming an image in an image forming station which performs the transfer later based on image density information of the toner image transferred to the transfer incurring member by an image forming station which performs the transfer earlier in a sequence of the image forming operations.

14 Claims, 10 Drawing Sheets

FIG. 4

| DENSITY OF SQUARE SECTION [%] | UNEVEN DENSITY LEVEL OF BLACK HALFTONE SECTION | |
|---|---|---|
| | EMBODIMENT 1 | COMPARATIVE EXAMPLE 1 |
| 50 | ○ | ○ |
| 60 | ○ | ○ |
| 70 | ○ | ○ |
| 80 | ○ | ○ |
| 90 | ○ | ○ |
| 100 | ○ | △ |
| 110 | ○ | △ |
| 120 | ○ | △ |
| 130 | ○ | △ |
| 140 | ○ | × |
| 150 | ○ | × |
| 160 | ○ | × |
| 170 | ○ | × |
| 180 | ○ | × |
| 190 | ○ | × |
| 200 | ○ | × |

○:WITHOUT OCCURRENCE △:SLIGHT OCCURRENCE ×:PERCEPTIBLE

| NUMBER OF IMAGE FORMING OPERATIONS B | |
|---|---|
| EMBODIMENT 1 | COMPARATIVE EXAMPLE 1 |
| 254 | 400 |

FIG. 6

| NUMBER OF PIXELS OF SQUARE SECTION | UNEVEN DENSITY LEVEL OF BLACK HALFTONE SECTION | |
|---|---|---|
| | EMBODIMENT 2 | COMPARATIVE EXAMPLE 1 |
| 5000 | ○ | ○ |
| 6000 | ○ | ○ |
| 7000 | ○ | ○ |
| 8000 | ○ | ○ |
| 9000 | ○ | ○ |
| 10000 | ○ | △ |
| 11000 | ○ | △ |
| 12000 | ○ | △ |
| 13000 | ○ | △ |
| 14000 | ○ | △ |
| 15000 | ○ | △ |
| 16000 | ○ | △ |
| 17000 | ○ | △ |
| 18000 | ○ | × |
| 19000 | ○ | × |
| 20000 | ○ | × |

○:WITHOUT OCCURRENCE △:SLIGHT OCCURRENCE ×:PERCEPTIBLE

| NUMBER OF IMAGE FORMING OPERATIONS B | |
|---|---|
| EMBODIMENT 1 | EMBODIMENT 2 |
| 254 | 113 |

FIG. 10

| TOTAL NUMBER OF SQUARES IN IMAGE | NUMBER OF PIXELS PER SQUARE | TOTAL NUMBER OF PIXELS IN IMAGE | TOTAL NUMBER OF PIXELS EXCEPT OUTERMOST PERIPHERAL PIXELS OF EACH SQUARE IN IMAGE | UNEVEN DENSITY OF BLACK HALFTONE SECTION | |
|---|---|---|---|---|---|
| | | | | EMBODIMENT 3 | EXAMPLE 3 |
| 1 | 10000 | 10000 | 9598 | ○ | △ |
| 16 | 625 | 10000 | 8432 | ○ | ○ |
| 100 | 100 | 10000 | 6200 | ○ | ○ |
| 400 | 25 | 10000 | 2800 | ○ | ○ |

○:WITHOUT OCCURRENCE △:SLIGHT OCCURRENCE ×:PERCEPTIBLE

| NUMBER OF IMAGE FORMING OPERATIONS B | |
|---|---|
| EMBODIMENT 3 | EMBODIMENT 2 |
| 68 | 113 |

IMAGE FORMING APPARATUS CONTROLLING CHARGING VOLTAGE BASED ON IMAGE DENSITY INFORMATION

BACKGROUND OF THE INVENTION

1. Field of the Invention

The present invention relates to an electrophotographic image forming apparatus, and more particularly, to a technology of charging and exposure.

2. Description of the Related Art

A typical electrophotographic image forming apparatus includes an image forming station configured to perform toner development with regard to an electrostatic latent image formed by exposing a charged photosensitive drum to form a toner image on the photosensitive drum, and a transfer portion configured to electrostatically transfer the toner image formed on the photosensitive drum to an image-receiving member. An image forming apparatus configured to form a full-color image includes a plurality of image forming stations, and, by transferring in sequence respective single-color toner images formed in the respective image forming stations to an image-receiving member such as an intermediate transfer member or a recording material so as to be superimposed on one another, a full-color image may be formed.

In the transfer portion, by a voltage applied to the transfer member, the toner image is electrostatically transferred from the surface of the photosensitive drum to the image-receiving member. In this case, transfer of charge from the transfer member to the photosensitive drum may cause fluctuations in a surface potential of the photosensitive drum. The extent of transfer of charge depends on whether the recording material as the image-receiving member is located in the transfer portion or not, that is, whether the recording material exists between the photosensitive drum and the transfer member or not. In particular, when the recording material is not introduced to the transfer portion, charge is liable to be transferred from the transfer member to the photosensitive drum, and thus, fluctuations in surface potential of the photosensitive drum are liable to occur. Therefore, after the recording material passes through the transfer portion, a surface potential difference may be caused on the photosensitive drum.

Further, when a toner image is formed on an image-receiving member such as a recording material or an intermediate transfer member, transfer of charge is suppressed by the toner. In the case of a full-color image forming apparatus, when a toner image is transferred in a downstream image forming station in a state in which a toner image is already formed on the image-receiving member in an upstream image forming station, the surface potential of the photosensitive drum is less liable to fluctuate at a location of the image-receiving member at which a toner image is already formed. Therefore, a surface potential difference may be caused on the photosensitive drum after the image-receiving member passes through the transfer portion between a location at which a toner image is already formed on the image-receiving member at the time of the transfer and a location at which a toner image is not formed as yet on the image-receiving member at the time of the transfer. Such a surface potential difference (transfer memory) on the photosensitive drum after the image-receiving member passes through the transfer portion may remain after the photosensitive drum is recharged by a charging unit, which is a cause of uneven density of a halftone image.

Transfer memory can be erased by increasing the amount of charge when recharging is performed by the charging unit. Japanese Patent Application Laid-Open No. 2008-8991 discloses means for forming a potential necessary for image formation by, after transfer memory is erased by charging a photosensitive drum to a potential which is higher than a potential necessary for image formation, exposing the surface of the photosensitive drum to light to a small extent.

However, with regard to the means disclosed in Japanese Patent Application Laid-Open No. 2008-8991, the photosensitive drum is charged to a potential which is higher than that necessary for image formation, and thus, electric discharge between the photosensitive drum and the charging unit may become larger and deterioration of the photosensitive drum may be accelerated. Further, a potential necessary for image formation is formed by exposing the photosensitive drum to light to a small extent, and thus, the exposure may also accelerate the deterioration of the photosensitive drum.

SUMMARY OF THE INVENTION

In order to solve the above-mentioned problem, the present application provides an image forming apparatus which can suppress halftone uneven density due to transfer memory and still can suppress deterioration of a photosensitive drum.

One representative configuration of an image forming apparatus disclosed herein includes: a plurality of image forming stations; and a control portion configured to control an image forming operation, each of the plurality of image forming stations including: an image bearing member configured to form a toner image on a surface thereof; and a charging device configured to charge the image bearing member, wherein respective toner images formed on image bearing members of the plurality of image forming stations are sequentially transferred to a transfer incurring member so as to be superimposed on top of each other, and wherein the control portion sets a voltage applied to the charging device in forming an image in an image forming station among the plurality of image forming stations which performs a transfer later, based on image density information of the toner image transferred to the transfer incurring member by an image forming station among the plurality of image forming stations which performs a transfer earlier in a sequence of image forming operations.

Further, another configuration of the image forming apparatus includes: a plurality of image forming stations; and a control portion configured to control an image forming operation, each of the plurality of image forming stations including: an image bearing member configured to form a toner image on a surface thereof; and a charging device configured to charge the image bearing member, the image forming apparatus further includes an exposure device configured to expose an image section and a non-image section of the image bearing member charged by the charging device at different exposure intensities to set surface potentials of the image section and the non-image section to a predetermined image section potential and a predetermined non-image section potential, respectively, wherein respective toner images formed on image bearing members of the plurality of image forming stations are sequentially transferred to a transfer incurring member so as to be superimposed on top of each other, and wherein the control portion sets a voltage applied to the charging device and the exposure intensities of the image section and the non-image section by the exposure device in forming an image in an image forming station among the plurality of image forming stations which performs a transfer later to first set values when image density information of the toner image transferred to the transfer incurring member by an image forming station among the plurality of image forming stations which performs a transfer earlier does not satisfy a predetermined high density condition, and to second set values when the image density information satisfies the predetermined high density condition in a sequence of image forming operations.

Further features of the present invention will become apparent from the following description of exemplary embodiments with reference to the attached drawings.

BRIEF DESCRIPTION OF THE DRAWINGS

FIG. 4 is tables showing the result of ascertaining the effect of the image forming sequence in Embodiment 1.

FIG. 6 is tables showing the result of ascertaining the effect of the image forming sequence in Embodiment 2.

FIG. 10 is tables showing the image forming sequence in Embodiment 3.

DESCRIPTION OF THE EMBODIMENTS

Exemplary embodiments of the present invention will be described in the following in detail with reference to the accompanying drawings. However, the dimensions, materials, shapes, relative positional relationship, and the like of structural elements described herein should be appropriately changed depending on the structure of the apparatus to which the present invention is applied and various conditions. Specifically, these are not meant to limit the scope of the present invention to the following embodiments.

Embodiment 1

An image forming apparatus according to Embodiment 1 of the present invention will be described. The image forming apparatus according to the embodiment is a full-color image forming apparatus of four colors, i.e., yellow, magenta, cyan, and black, which uses an electrophotographic process and has a resolution of 600 dpi. The image forming apparatus forms an image on a sheet-shaped recording material P as a recording medium based on electrical image signals which are input from a host device such as an image reader, a personal computer, or a facsimile machine to a control portion. The control portion exchanges various kinds of electrical information with the host device, and exercises centralized control over image forming operation of the image forming apparatus in accordance with a predetermined control program or a lookup table.

Figure 1:
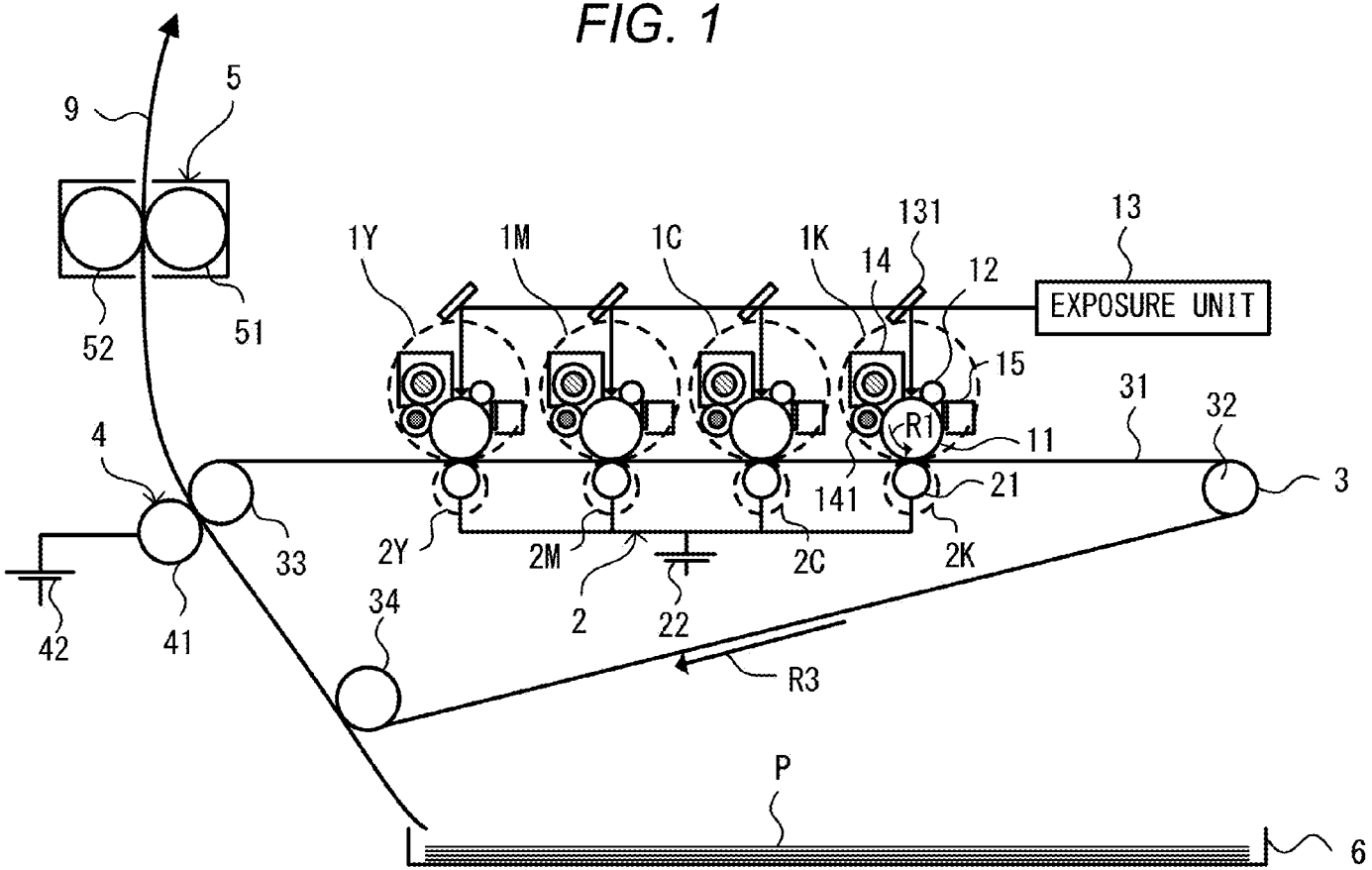
FIG. 1 is a schematic explanatory diagram of an image forming apparatus.

FIG. 1 illustrates a schematic structure of the image forming apparatus according to the embodiment. As illustrated in FIG. 1, the image forming apparatus according to the embodiment includes four image forming stations 1Y, 1M, 1C, and 1K (sometimes generically referred to hereafter with reference numeral 1 without identifying postscript Y, M, C, or K), primary transfer portions 2, an intermediate transfer unit 3, a secondary transfer portion 4, a fixing portion 5, and a recording material conveyance path 9. Single-color toner images (developer images) formed in the image forming stations 1Y, 1M, 1C, and 1K are transferred in sequence to an intermediate transfer belt (intermediate transfer member) 31 of the intermediate transfer unit 3 so as to be superimposed on one another at primary transfer portions 2Y, 2M, 2C, and 2K, respectively. In this way, a full-color toner image is formed on the intermediate transfer belt 31 as an image-receiving member (transfer incurring member). The full-color toner image formed on the intermediate transfer belt 31 is conveyed to the secondary transfer portion 4 by rotationally driving the intermediate transfer belt 31, and is transferred onto the recording material P at the secondary transfer portion 4. The recording material P bearing the full-color toner image is conveyed to the fixing portion 5, and the full-color toner image is fixed thereto by being heated and pressurized.

The image forming stations 1Y, 1M, 1C, and 1K are different only in color of the toner (developer) used, and are the same in structure. In this case, only the structure of the image forming station 1K will be described as a representative. The image forming station 1K includes a photosensitive drum 11, a charging unit 12, an exposure unit 13, a developing unit 14, and a cleaning unit 15. The photosensitive drum (image bearing member) 11 is rotationally driven about the axis of the photosensitive drum 11 in a direction indicated by an arrow R1 at a predetermined speed. The charging unit 12 is a unit configured to uniformly charge the surface of the photosensitive drum 11 in a predetermined polarity (in the embodiment, negative polarity) to a predetermined potential, and, in the embodiment, a contact charging roller is used (hereinafter referred to as a charging roller 12). The exposure unit 13 (hereinafter referred to as a scanner 13) is a unit configured to form an electrostatic latent image on the surface of the photosensitive drum 11, and, in the embodiment, a laser scanner unit having mirrors 131 is used. The scanner 13 scans and exposes the charged surface of the photosensitive drum 11 in accordance with image forming information which is input from a control portion 8 (see FIG. 2) as a control unit and as an acquiring unit configured to acquire image density information, changes the surface potential of the photosensitive drum 11, and forms an electrostatic latent image on the photosensitive drum 11. The image forming information is data which is image information input from the host device and is converted to a format in which the image forming apparatus can form an image therefrom. The image forming information is formed in the control portion 8. The image forming information has a resolution of 600 dpi, and includes yellow, magenta, cyan, and black density information with regard to the respective pixels. The density information of the respective colors is 0% at the minimum and 100% at the maximum. The density can be adjusted by the exposure intensity. When the exposure intensity is higher, the density becomes higher, and, when the exposure intensity is lower, the density becomes lower.

The developing unit 14 is a contact development type and reversal development type developing device which uses nonmagnetic black toner, whose normal charging polarity is negative, as the toner. The normal charging polarity means the charging polarity of toner when used for development. When reversal development is performed on a negatively charged photosensitive drum 11, the normal charging polarity is negative. The developing unit 14 includes a development roller 141 configured to bear toner. The development roller 141 is brought into contact with the photosensitive drum 11 to develop the electrostatic latent image on the photosensitive drum 11.

The primary transfer portions 2Y, 2M, 2C, and 2K are different only in that the image forming stations 1 (1Y, 1M, 1C, and 1K) corresponding thereto are different, and are the same in structure. In this case, only the primary transfer portion 2K will be described as a representative. The primary transfer portion 2K includes a primary transfer roller 21 as a transfer member (transfer unit). A voltage is applied to the primary transfer roller 21 from a power supply portion 22. The intermediate transfer unit 3 includes three rollers, i.e., a driving roller 32, a secondary transfer opposed roller 33, and a tension roller 34, over which the intermediate transfer belt 31 is stretched. By rotationally driving the driving roller 32, the intermediate transfer belt 31 is rotated in a direction indicated by an arrow R3. The primary transfer roller 21 is a porous roller formed of a conductive resin, and the intermediate transfer belt 31 is a dielectric thin film belt formed of a conductive resin. The primary transfer roller 21 is in pressure contact with the photosensitive drum 11 with the intermediate transfer belt 31 sandwiched therebetween (via the intermediate transfer belt 31). By applying a voltage to the primary transfer roller 21 in opposite polarity to the normal charging polarity of the toner (positive polarity), the toner image on the photosensitive drum 11 is electrostatically transferred onto the intermediate transfer belt 31. The transfer starts in the primary transfer portions 2Y, 2M, 2C, and 2K in this order, and a full-color toner image is formed in which yellow, magenta, cyan, and black toner images are superimposed in this order from bottom to top on the intermediate transfer belt 31. By rotationally driving the intermediate transfer belt 31, the full-color toner image formed on the intermediate transfer belt 31 is conveyed to the secondary transfer portion 4.

The secondary transfer portion 4 includes a secondary transfer roller 41 as a secondary transfer unit, and a voltage is applied thereto from a power supply portion 42. The secondary transfer roller 41 is a porous roller formed of a conductive resin, and is provided so as to be in pressure contact with the secondary transfer opposed roller 33 with the intermediate transfer belt 31 sandwiched therebetween. One sheet-shaped recording material P is separated and is fed from a paper feed cassette 6 in synchronization with the conveyance to the secondary transfer portion 4 of the full-color toner image formed on the intermediate transfer belt 31. The recording material P is introduced to the pressure contact portion between the secondary transfer roller 41 and the intermediate transfer belt 31, and a voltage is applied to the secondary transfer roller 41 in opposite polarity to the normal charging polarity of the toner (positive polarity), thereby electrostatically transferring the full-color toner image on the intermediate transfer belt 31.

The fixing portion 5 includes a fuser roller 51 and a pressure roller 52 as a fixing unit. The fuser roller 51 and the pressure roller 52 are provided so as to be in pressure contact with each other. The fuser roller 51 is heated to a predetermined temperature by a heating unit (not shown). The recording material P which bears the full-color toner image is heated and pressurized by being conveyed to a pressure contact portion between the fuser roller 51 and the pressure roller 52, and the full-color toner image is fixed onto the recording material P.

<Image Forming Operation of Image Forming Station 1>

The image forming station 1 in the embodiment is adapted to be able to perform two kinds of image forming operations, i.e., image forming operation A and image forming operation B. These image forming operations are different from each other in a magnitude of a voltage (charging voltage) applied to the charging roller 12 and exposure intensity by the scanner 13.

In the image forming operation A, after the rotational driving of the photosensitive drum 11 and the development roller 141 starts, a voltage of −1,000 V (first set value) is applied to the charging roller 12, and a voltage of −300 V is applied to the development roller 141. In this case, the photosensitive drum 11 is charged by the charging roller 12 to −450 V as a non-image section potential. The non-image section potential is a potential of a portion on the photosensitive drum 11 in which toner development is not performed. The potential difference (Vback) between the non-image section potential and the potential of the development roller 141 is 150 V. Then, only an image section on the photosensitive drum 11 which is charged to the non-image section potential is scanned and exposed by the scanner 13 with the exposure intensity of 0.3 $\mu J/cm^2$ (first set value) in accordance with the image forming information to form an electrostatic latent image on the photosensitive drum 11. In this case, the section of the photosensitive drum 11 which bears the electrostatic latent image is charged to −100 V as an image section potential. The potential difference (Vcont) between the image section potential and the potential of the development roller 141 is 200 V. Finally, by adhering toner to the electrostatic latent image formed on the photosensitive drum 11 by the development roller 141, the toner image is formed on the photosensitive drum 11.

In the image forming operation B, after the rotational driving of the photosensitive drum 11 and the development roller 141 starts, a voltage of −1,100 V (second set value) is applied to the charging roller 12, and a voltage of −300 V is applied to the development roller 141. In this case, the photosensitive drum 11 is charged by the charging roller 12 to −550 V whose absolute value is larger than that of the non-image section potential in the image forming operation A. Then, the charged photosensitive drum 11 is exposed by the scanner 13 with the exposure intensity of 0.35 $\mu J/cm^2$ (second set value) in accordance with the image forming information to form an electrostatic latent image. In this case, the section of the photosensitive drum 11 which bears the electrostatic latent image is charged to −100 V as the image section potential, and Vcont is 200 V. At the same time, the section of the photosensitive drum 11 other than the section which bears the electrostatic latent image is exposed by the scanner 13 with the exposure intensity of 0.05 $\mu J/cm^2$ (second set value). The exposure causes the potential of the section of the surface of the photosensitive drum 11 other than the section which bears the electrostatic latent image to become smaller in the absolute value from −550 V to −450 V as the non-image section potential, and Vback becomes 150 V. Finally, by performing toner development of the electrostatic latent image formed on the photosensitive drum 11 by the development roller 141, the toner image is formed on the photosensitive drum 11.

As described above, the image forming operation B is an image forming operation in which a voltage higher than a voltage in the case of the image forming operation A is applied to the charging roller 12, and, in this setting, transfer memory on the photosensitive drum 11 is readily erased. However, simply increasing the voltage applied to the charging roller 12 results in different parameter values which controls the development characteristics of the toner such as Vback and Vcont from those in the case of the image forming operation A. Therefore, in the image forming operation B, by setting the exposure intensity by the scanner 13 of the photosensitive drum 11 to be higher than an exposure intensity in the image forming operation A, the values of Vback and Vcont are set to be equivalent to those in the case of the image forming operation A. In other words, the exposure intensity is controlled in accordance with the magnitude of the voltage applied to the charging roller 12.

<Image Forming Sequence>

Figure 2:
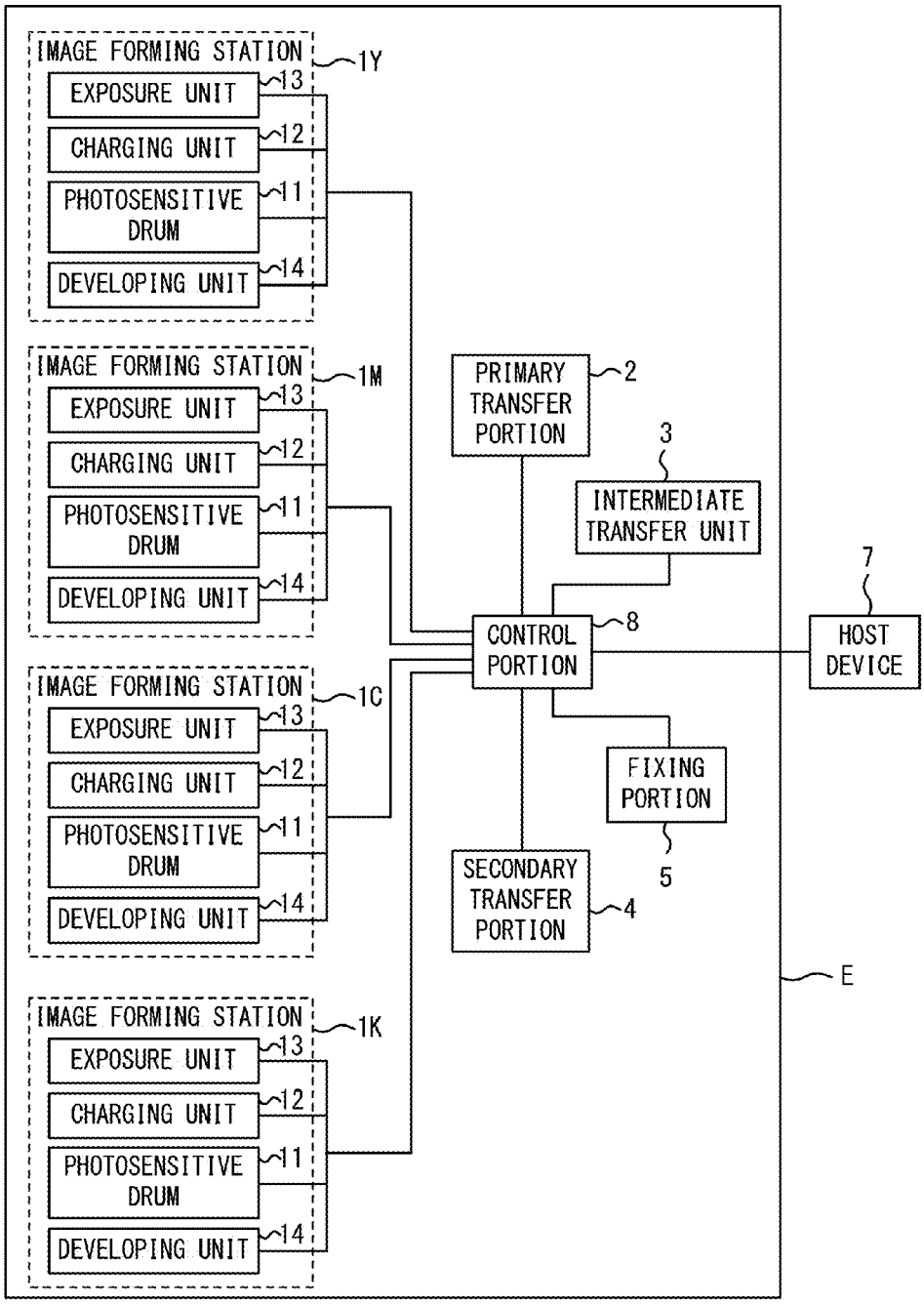
FIG. 2 is a block diagram of the image forming apparatus.
Figure 3:
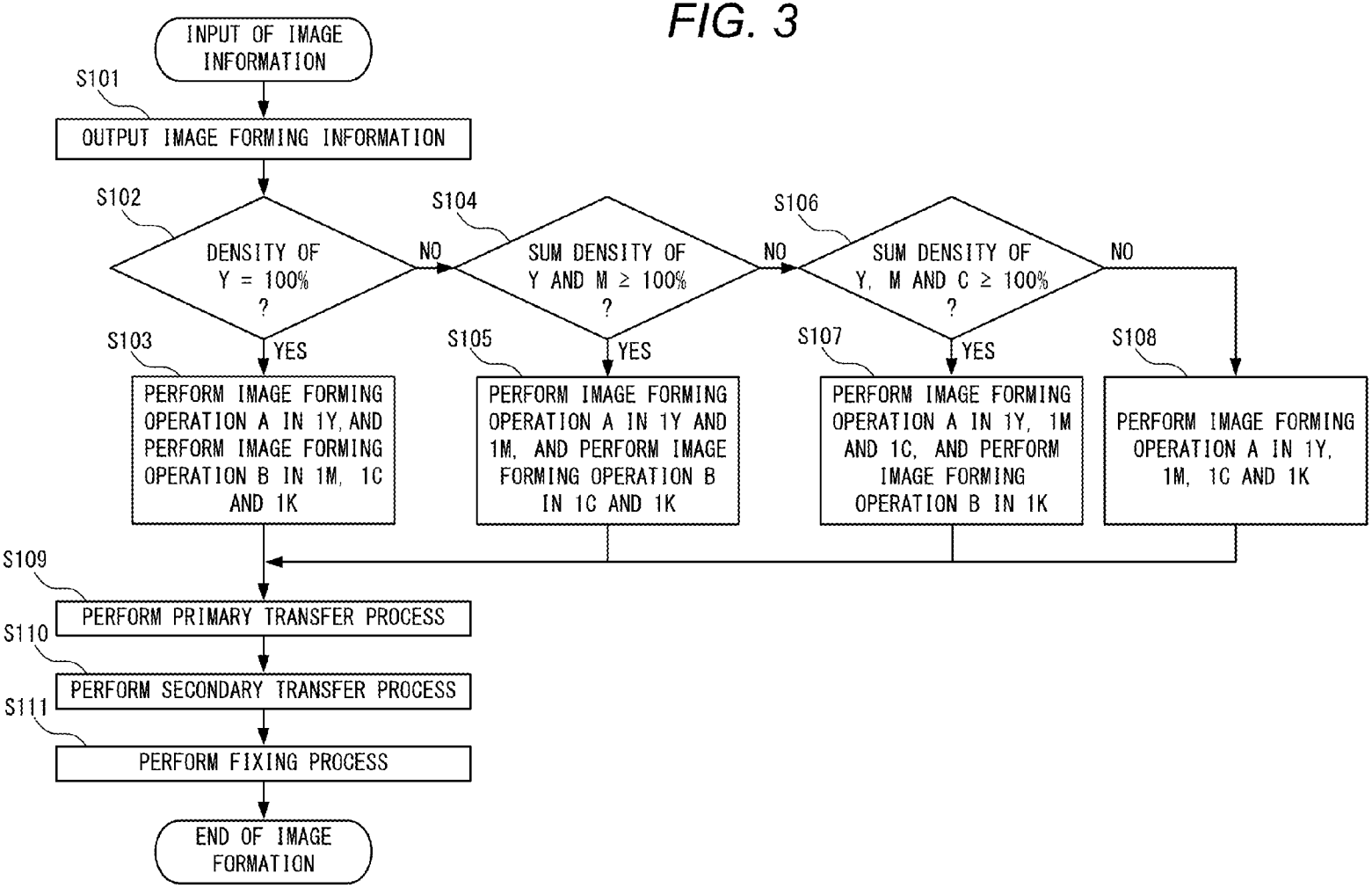
FIG. 3 is a flowchart of an image forming sequence in Embodiment 1.

An image forming sequence in Embodiment 1 will be described with reference to FIG. 2 and FIG. 3. FIG. 2 is a block diagram of an image forming apparatus E according to the embodiment of the present invention. FIG. 3 is a flowchart of the image forming sequence in the image forming apparatus according to Embodiment 1.

When image information is input from the host device 7 to the control portion 8 illustrated in FIG. 2, the input image information is converted in the control portion 8 to image forming information (S101). Then, the control portion 8 determines whether there is a pixel in which the density of yellow is 100% in the image forming information or not (S102). When there is at least one pixel in which the density of yellow is 100% in the image forming information, in accordance with a command from the control portion 8, the image forming station 1Y performs the image forming operation A and the image forming stations 1M, 1C, and 1K perform the image forming operation B (S103). When there is no pixel in which the density of yellow is 100% in the image forming information, the control portion 8 determines whether there is a pixel in which the sum density of yellow and magenta is 100% or more in the image forming information or not (S104). When there is a pixel in which the sum density of yellow and magenta is 100% or more in the image forming information (when a high density condition is satisfied), in accordance with a command from the control portion 8, the image forming stations 1Y and 1M perform the image forming operation A and the image forming stations 1C and 1K perform the image forming operation B (S105). When there is no pixel in which the sum density of yellow and magenta is 100% or more in the image forming information (when a high density condition is not satisfied), the control portion 8 determines whether there is a pixel in which the sum density of yellow, magenta, and cyan is 100% or more in the image forming information or not (S106). When there is a pixel in which the sum density of yellow, magenta, and cyan is 100% or more in the image forming information, in accordance with a command from the control portion 8, the image forming stations 1Y, 1M, and 1C perform the image forming operation A and the image forming station 1K performs the image forming operation B (S107). When there is no pixel in which the sum density of yellow, magenta, and cyan is 100% or more in the image forming information, in accordance with a command from the control portion 8, all the image forming stations 1Y, 1M, 1C, and 1K perform the image forming operation A (S108). After the image forming operation ends in all of the image forming stations, in accordance with a command from the control portion 8 to the primary transfer portions 2, the intermediate transfer unit 3, the secondary transfer portion 4, and the fixing portion 5, a primary transfer process, a secondary transfer process, and a fixing process are performed in sequence (S109, S110, and S111). Then, the image forming operation of the image forming apparatus ends.

<Result of Ascertaining Effect of Suppressing Transfer Memory and Effect of Suppressing Photosensitive Drum Deterioration>

For the sake of the ascertainment of the effect of the embodiment by comparison, the following Comparative Example 1 was used.

Comparative Example 1

In Comparative Example 1, the image forming stations 1Y, 1M, 1C, and 1K always performed the image forming operation B described in Embodiment 1 as the image forming operation, irrespective of the image forming information. Except for this, the structure of the Comparative Example 1 is the same as the structure of Embodiment 1, and thus, description thereof is omitted.

Figure 7A:
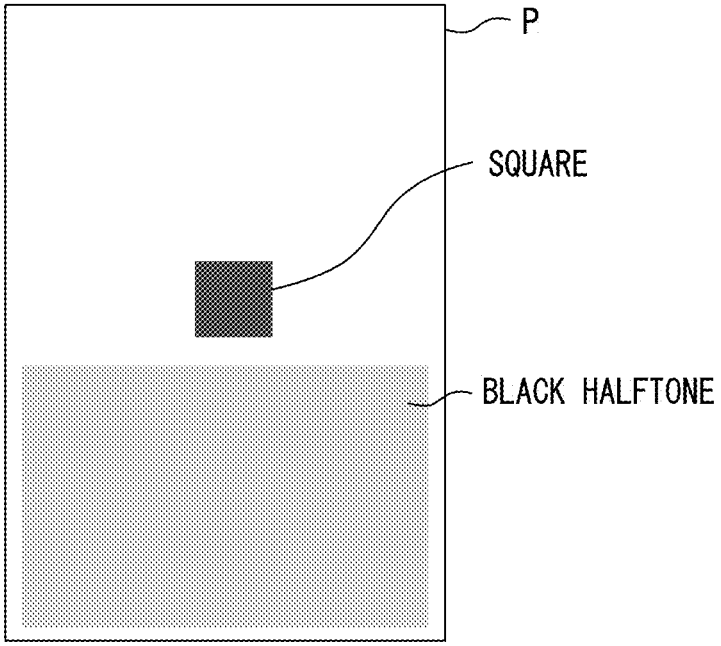
FIGS. 7A and 7B are explanatory diagrams of an image for ascertainment in Embodiment 1.
Figure 7B:
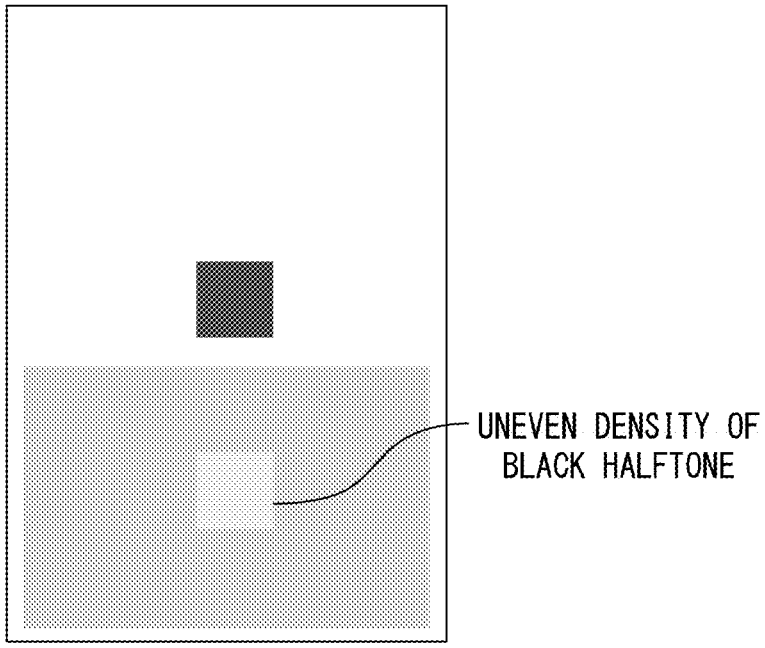

As an image for ascertaining transfer memory, as illustrated in FIG. 7A, an image was used in which a square having 10,000 pixels of a uniform mixture of yellow, magenta, and cyan was placed at the center of the image and a black halftone having a density of 40% was placed in a rear end section of the image. When transfer memory was caused on the photosensitive drum 11 due to the transfer of the toner image of the square of the mixture of yellow, magenta, and cyan, as illustrated in FIG. 7B, uneven density due to the transfer memory appeared in the black halftone downstream from the square in the direction of conveyance of the intermediate transfer belt by one circumference of the photosensitive drum. Further, the black halftone uneven density of the image for ascertaining transfer memory became worse as the density of the square section became higher. Therefore, images for ascertaining transfer memory in which the sum density of YMC in the square section was from 50% to 200% in increments of 10% were printed by both the image forming apparatus of the embodiment and the image forming apparatus of Comparative Example 1, and the level of the uneven density in the black halftone was reviewed.

For the ascertainment of the effect of suppressing photosensitive drum deterioration, 100 kinds of various images such as letters and figures were used. Each of the 100 kinds of images was printed on one recording material P at a time using the image forming apparatus of the embodiment and the image forming apparatus of Comparative Example 1. The total number of the image forming operations B performed in the image forming stations 1Y, 1M, 1C, and 1K in the printing process was recorded. In the image forming operation B, the voltage applied to the charging roller 12 is higher than that in the case of image forming operation A, and exposure to the non-image section is also performed, and thus, deterioration of the photosensitive drum 11 is accelerated compared with the case of the image forming operation A. Therefore, it can be said that, as the recorded total number of the image forming operations B becomes smaller, the deterioration of the photosensitive drum 11 is to a smaller extent. Which of the image forming operation A and the image forming operation B was performed in the image forming stations 1Y, 1M, 1C, and 1K was determined in the following way. Specifically, voltages applied to the charging rollers 12Y, 12M, 12C, and 12K were always measured while the 100 kinds of images were printed. When the voltage of 1,000 V was applied, it was determined that the image forming operation A was performed. When the voltage of 1,100 V was applied, it was determined that the image forming operation B was performed.

FIG. 4 shows the result of ascertaining the effect of suppressing transfer memory and the effect of suppressing photosensitive drum deterioration in the embodiment. In Comparative Example 1, when the density of the square section was 100% or more, the black halftone uneven density appeared. In the embodiment, the black halftone uneven density did not appear even in regions in which the density of the square section was 100% or more. Therefore, it can be seen that, by using the image forming sequence of the embodiment, the halftone uneven density due to transfer memory can be suppressed.

Further, in the embodiment, the total number of the image forming operations B performed in the image forming stations 1Y to 1K was 254. In contrast, in Comparative Example 1, the total number of the image forming operations B performed in the image forming stations 1Y to 1K was 400.

Therefore, it can be seen that, by using the image forming sequence of Embodiment 1, the number of the image forming operations B to be performed can be reduced to suppress deterioration of the photosensitive drum 11.

As described above, in the embodiment, in the sequence of the image forming operations, the set values of the charging voltage and the exposure intensity when an image is formed are changed with regard to the respective image forming stations, depending on whether the image density information of the toner images which are superimposed in sequence on the intermediate transfer belt 31 satisfies the predetermined high density condition or not. The set values of the charging voltage are set so that the absolute value of the charged potential formed by the set values of the charging voltage when the high density condition is satisfied is larger than that when the high density condition is not satisfied. Further, the set values of the exposure intensity are set so that the image section potentials formed by the set values of the exposure intensity are the same and the non-image section potentials formed by the set values of the exposure intensity are the same. This can eliminate excessive application of the charging voltage and excessive enhancement of the exposure intensity, and, halftone uneven density due to transfer memory can be suppressed and still deterioration of the photosensitive drum can be suppressed. In particular, when the high density condition is not satisfied, differently from the case of Embodiment 1, the non-image section may be exposed to a small extent, but, by adjusting the charging voltage and the like so that the non-image section is not exposed as in Embodiment 1, deterioration of the photosensitive drum can be suppressed more effectively.

In the image forming apparatus of the embodiment, the threshold value of the image density for performing the image forming operation B was set to be 100%, but the possibility of occurrence of transfer memory depends on the structure of the image forming stations and the primary transfer portion, and thus, it is preferred that the threshold value be set in accordance with the kind of the image forming apparatus. Further, in the embodiment, an in-line image forming apparatus was used, but it goes without saying that a similar effect can be obtained with a four-cycle image forming apparatus. Further, in the embodiment, an intermediate transfer type image forming apparatus was used in which a toner image was transferred to an intermediate transfer unit at a primary transfer portion, but it goes without saying that a similar effect can be obtained with a direct transfer type image forming apparatus in which a toner image is transferred to a recording material P as an image-receiving member (transfer incurring member) at a primary transfer portion. Further, in the embodiment, two kinds of image forming operations can be performed in accordance with the high density condition, but a plurality of threshold values may be provided in stages and three or more kinds of image forming operations having different set values may be performed.

Embodiment 2

An image forming apparatus according to Embodiment 2 of the present invention will be described. An overview of the image forming apparatus according to the embodiment is similar to that according to Embodiment 1. The image forming apparatus according to the embodiment has a feature in that which of the image forming operation A and the image forming operation B is selected as the image forming operation in the image forming stations 1 is determined by whether the number of pixels in the image forming information in which the density is equal to or higher than predetermined density is equal to or larger than a predetermined number or not. Points different from those in Embodiment 1 will be mainly described herein, and like reference numerals are used to designate like structural elements which are similar to those in Embodiment 1 and description thereof is omitted. Points which are not described here are similar to those in Embodiment 1.

<Image Forming Sequence>

Figure 5:
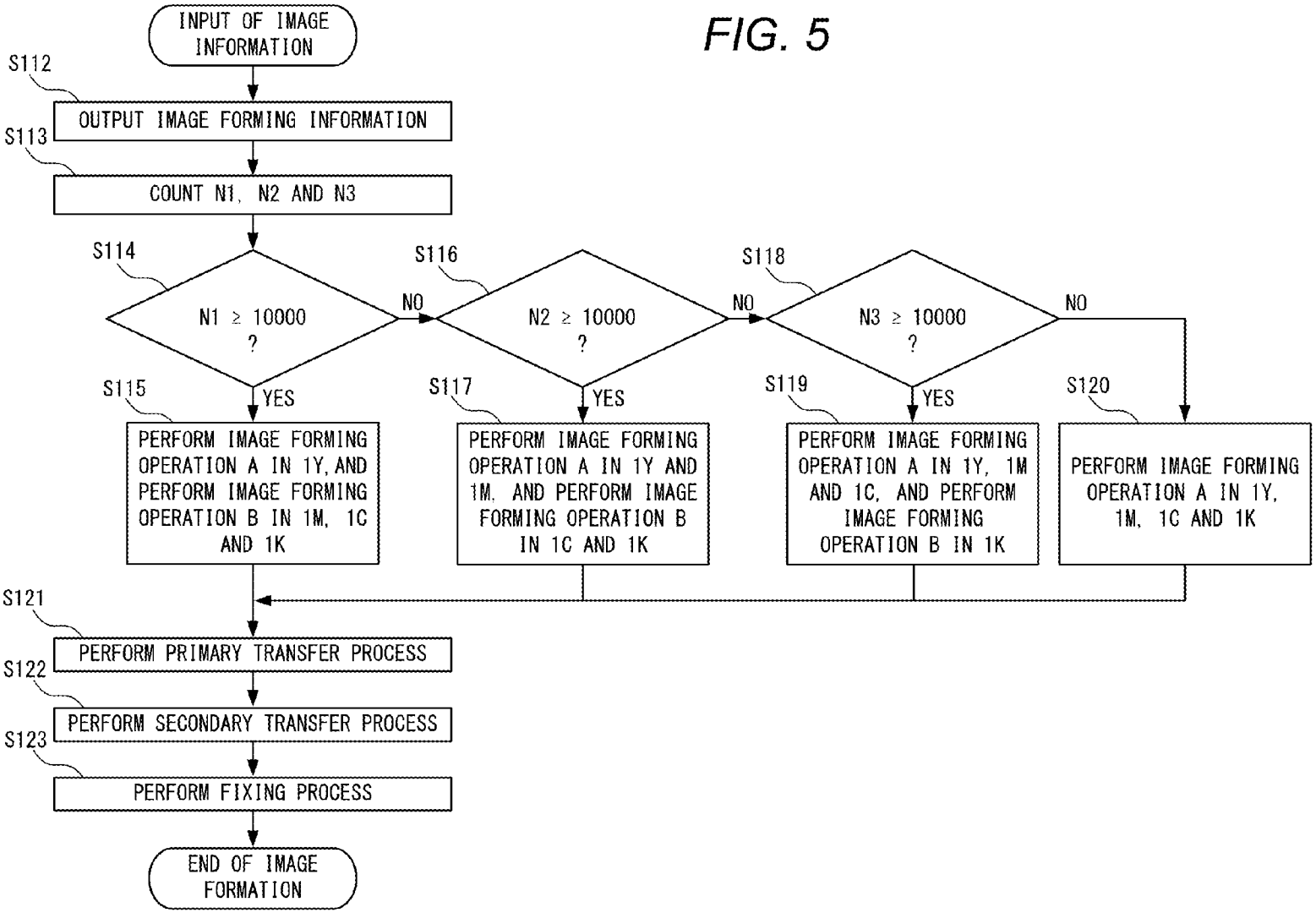
FIG. 5 is a flowchart of an image forming sequence in Embodiment 2.

An image forming sequence in Embodiment 2 will be described with reference to FIG. 2 and FIG. 5. FIG. 5 is a flowchart of the image forming sequence in the image forming apparatus according to Embodiment 2.

When image information is input from the host device 7 to the control portion 8 illustrated in FIG. 2, the control portion 8 converts the input image information into image forming information (S112). Then, the control portion 8 counts a number N1 of pixels in which the density of yellow is 100%, a number N2 of pixels in which the sum density of yellow and magenta is 100% or more, and a number N3 of pixels in which the sum density of yellow, magenta, and cyan is 100% or more in the image forming information (S113). After that, the control portion 8 determines whether N1 is equal to or larger than 10,000 or not (S114). When N1 is equal to or larger than 10,000, in accordance with a command from the control portion 8, the image forming station 1Y performs the image forming operation A and the image forming stations 1M, 1C, and 1K perform the image forming operation B (S115). When N1 is smaller than 10,000, the control portion 8 determines whether N2 is equal to or larger than 10,000 or not (S116). When N2 is equal to or larger than 10,000, in accordance with a command from the control portion 8, the image forming stations 1Y and 1M perform the image forming operation A and the image forming stations 1C and 1K perform the image forming operation B (S117). When N2 is smaller than 10,000, the control portion 8 determines whether N3 is equal to or larger than 10,000 or not (S118). When N3 is equal to or larger than 10,000, in accordance with a command from the control portion 8, the image forming stations 1Y, 1M, and 1C perform the image forming operation A and the image forming station 1K performs the image forming operation B (S119). When N3 is smaller than 10,000, in accordance with a command from the control portion 8, all the image forming stations 1Y, 1M, 1C, and 1K perform the image forming operation A (S120). After the image forming operation ends in the image forming stations 1Y to 1K, in accordance with a command from the control portion 8 to the primary transfer portions 2, the intermediate transfer unit 3, the secondary transfer portion 4, and the fixing portion 5, a primary transfer process, a secondary transfer process, and a fixing process are performed in sequence (S121, S122, and S123). Then, the image forming operation of the image forming apparatus ends.

<Result of Ascertaining Effect of Suppressing Transfer Memory and Effect of Suppressing Photosensitive Drum Deterioration>

As an image for ascertaining transfer memory, an image was used in which a square having a density of 200% of a uniform mixture of yellow, magenta, and cyan was placed at the center of the image and a black halftone having a density of 40% was placed in a rear end section of the image (see FIG. 7A). The black halftone uneven density of the image for ascertaining transfer memory became worse as the area of the square section became larger. Therefore, images for ascertaining transfer memory in which the number of pixels forming the square section were from 5,000 to 20,000 in increments of 1,000 were printed by the image forming apparatus according to the embodiment, and the level of occurrence of the uneven density in the black halftone was reviewed. Further, as Comparative Example 2, the image for ascertaining transfer memory was printed by the image forming apparatus according to Comparative Example 1 of Embodiment 1 and the level of occurrence of the uneven density in the black halftone was reviewed.

For the ascertainment of the effect of suppressing photosensitive drum deterioration, 100 kinds of various images such as letters and figures were used. Each of the 100 kinds of images was printed on one recording material P at a time using the image forming apparatus of the embodiment and the image forming apparatus of Embodiment 1. The total number of the image forming operations B performed in the image forming stations 1Y, 1M, 1C, and 1K in the printing process was recorded.

FIG. 6 shows the result of ascertaining the effect of suppressing transfer memory and the effect of suppressing photosensitive drum deterioration in the embodiment. In Comparative Example 1, when the number of pixels of the square section was 10,000 or more, the black halftone uneven density appeared. In the embodiment, the black halftone uneven density did not appear even in regions in which the number of pixels of the square section was 10,000 or more. Therefore, it can be seen that, by using the image forming sequence of the embodiment, the halftone uneven density due to transfer memory can be suppressed.

Further, in the embodiment, the total number of the image forming operations B performed in the image forming stations 1Y, 1M, 1C, and 1K when the images for ascertaining photosensitive drum deterioration were printed was 113. On the other hand, in Embodiment 1, the total number of the image forming operations B performed when the images for ascertaining photosensitive drum deterioration were printed was 254. Therefore, it can be seen that, by using the image forming sequence of the embodiment, deterioration of the photosensitive drum 11 can be further suppressed compared with the case of Embodiment 1.

In the image forming apparatus according to the embodiment, the threshold value of the image density for performing the image forming operation B was set to be 100% and the threshold value of the total number of pixels in which the image density was 100% or more was set to be 10,000. However, the possibility of occurrence of transfer memory depends on the structure of the image forming stations and the primary transfer portion, and thus, it is preferred that the threshold values be set in accordance with the kind of the image forming apparatus. Further, a plurality of threshold values as described above may be provided in stages and three or more kinds of image forming operations having different set values may be performed.

Embodiment 3

Embodiment 3 of the present invention will be described. An overview of an image forming apparatus according to the embodiment is similar to that according to Embodiment 1. The image forming apparatus according to the embodiment has a feature in that which of the image forming operation A and the image forming operation B is selected as the image forming operation in the image forming stations 1 is determined in the following way. Specifically, the determination is made by whether the total number of pixels among the pixels in the image forming information in which the density is equal to or higher than density set in advance and pixels in a peripheral region of which also have density that is equal to or higher than the density set in advance is equal to or larger than a predetermined number or not. An image forming sequence of the image forming apparatus of the embodiment according to the present invention will be described with reference to FIG. 2 and FIG. 8.

Figure 8:
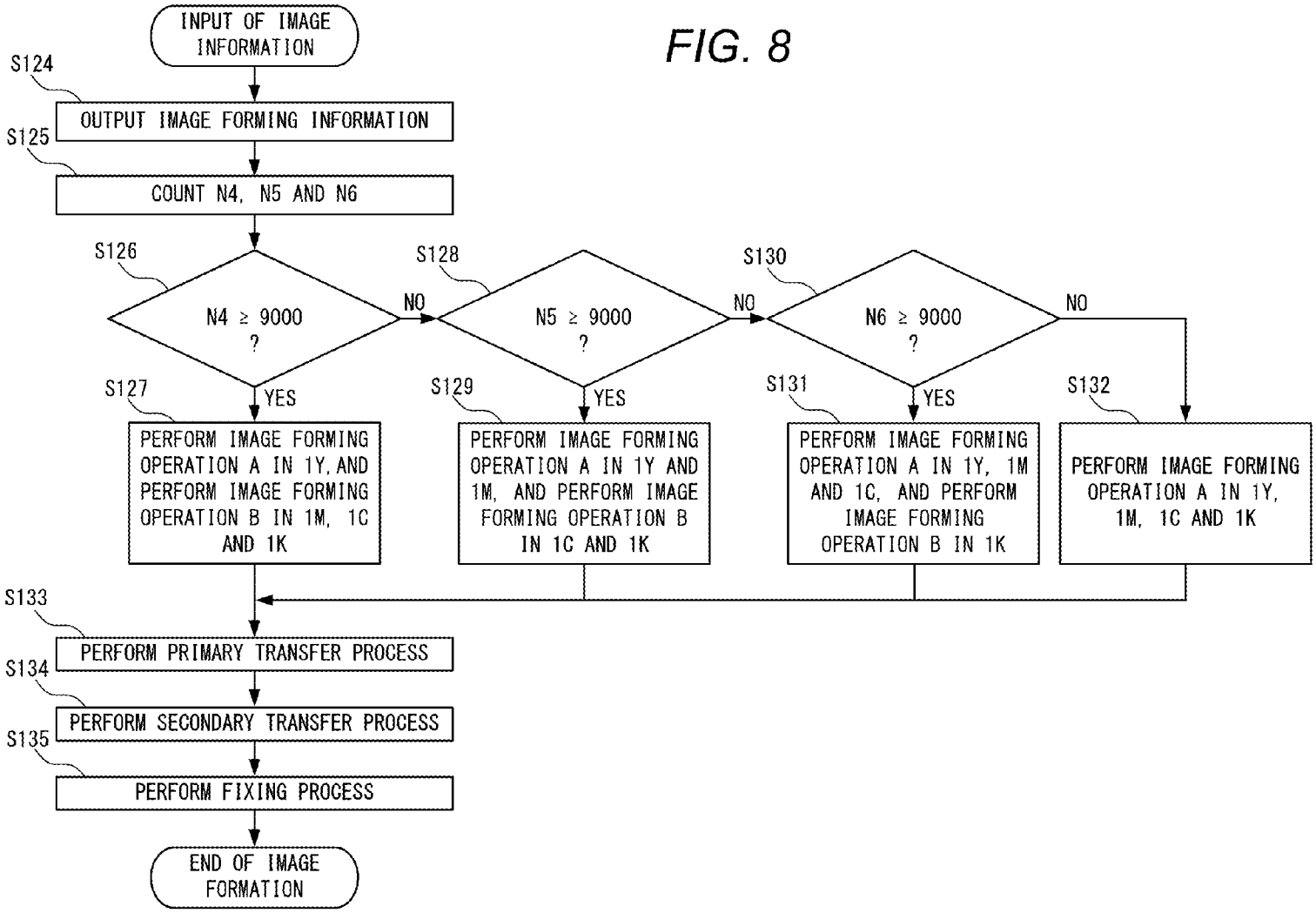
FIG. 8 is a flowchart of an image forming sequence in Embodiment 3.

FIG. 8 is a flowchart of the image forming sequence of the image forming apparatus of the embodiment. When image information is input from the host device 7 to the control portion 8 illustrated in FIG. 2, first, as shown by S124 in FIG. 8, the control portion 8 converts the input image information into image forming information. Then, as shown by S125, the control portion 8 counts a number N4 of pixels, among pixels in the image forming information in which the density of yellow is 100%, pixels adjacent to which also have the density of yellow of 100%. Adjacent pixels as used herein mean all the pixels which are in contact.

Similarly, the control portion 8 counts a number N5 of pixels, among pixels in the image forming information in which the sum density of yellow and magenta is 100% or more, pixels adjacent to which also have the sum density of yellow and magenta of 100% or more. Further, the control portion 8 counts a number N6 of pixels, among pixels in the image forming information in which the sum density of yellow, magenta, and cyan is 100% or more, pixels adjacent to which also have the sum density of yellow, magenta, and cyan of 100% or more.

After that, as shown by S126, the control portion 8 determines whether N4 is equal to or larger than 9,000 or not. When N4 is equal to or larger than 9,000, as shown by S127, in accordance with a command from the control portion 8, the image forming station 1Y performs the image forming operation A and the image forming stations 1M, 1C, and 1K perform the image forming operation B.

When N4 is determined in S126 to be smaller than 9,000, as shown by S128, the control portion 8 determines whether N5 is equal to or larger than 9,000 or not. When N5 is equal to or larger than 9,000, as shown by S129, in accordance with a command from the control portion 8, the image forming stations 1Y and 1M perform the image forming operation A and the image forming stations 1C and 1K perform the image forming operation B. When N5 is determined in S128 to be smaller than 9,000, as shown by S130, the control portion 8 determines whether N6 is equal to or larger than 9,000 or not. When N6 is equal to or larger than 9,000, as shown by S131, in accordance with a command from the control portion 8, the image forming stations 1Y, 1M, and 1C perform the image forming operation A and the image forming station 1K performs the image forming operation B. When N6 is determined in S130 to be smaller than 9,000, as shown by S132, in accordance with a command from the control portion 8, all the image forming stations 1Y, 1M, 1C, and 1K perform the image forming operation A.

After the image forming operation ends in the image forming stations 1Y to 1K, as shown by S133, S134, and S135, in accordance with a command from the control portion 8 to the primary transfer portions 2, the intermediate transfer unit 3, the secondary transfer portion 4, and the fixing portion 5, the primary transfer process, the secondary transfer process, and the fixing process are performed in sequence. After that, the image forming operation of the image forming apparatus ends.

Next, the result of ascertaining the effect of suppressing transfer memory and the effect of suppressing photosensitive drum deterioration in the embodiment will be described. As an image for ascertaining transfer memory, an image illustrated in FIG. 9A was used in which a square having 10,000 pixels in total of a uniform mixture of yellow, magenta, and cyan and having a density of 200% was placed at the center of the image and a black halftone having a density of 40% was placed in a rear end section of the image. Further, an image illustrated in FIG. 9B was used in which a plurality of squares of a uniform mixture of yellow, magenta, and cyan having a density of 200% was placed at the center of the image and a black halftone having a density of 40% was placed in a rear end section of the image.

As the image for ascertaining transfer memory having the plurality of squares placed therein, three kinds of images were prepared in which the total number of the squares placed was 16, 100, and 400, respectively. The distance between the squares placed in each of the images for ascertaining transfer memory was uniform, and the total number of the pixels in the squares placed in each of the images for ascertaining transfer memory was 10,000. Therefore, in the image for ascertaining transfer memory in which the total number of the squares placed was 16, the number of pixels per square was 625. In the image for ascertaining transfer memory in which the total number of the squares placed was 100, the number of pixels per square was 100. In the image for ascertaining transfer memory in which the total number of the squares placed was 400, the number of pixels per square was 25. The four kinds of images for ascertaining transfer memory described above were printed by the image forming apparatus of the embodiment, and the level of occurrence of the uneven density in the black halftone was reviewed. Further, as Comparative Example 3, the images for ascertaining transfer memory described above were printed by the image forming apparatus of Comparative Example 1, and the level of the uneven density in the black halftone was reviewed.

For the ascertainment of the effect of suppressing photosensitive drum deterioration, 100 kinds of various images such as letters and figures were used. Each of the 100 kinds of images was printed on one recording material P at a time using the image forming apparatus of the embodiment and the image forming apparatus of Example 2. The total number of the image forming operations B performed in the image forming stations 1Y, 1M, 1C, and 1K in the printing process was recorded.

FIG. 10 shows the result of ascertaining the effect of suppressing transfer memory and the effect of suppressing photosensitive drum deterioration in the embodiment. While uneven density was partly caused in the black halftone in Comparative Example 3, in the embodiment, no uneven density was caused in the black halftone, and it can be seen that halftone uneven density due to transfer memory was able to be suppressed.

Further, as shown in the result of Comparative Example 3, it can be seen that, even though the total numbers of the pixels in the squares placed in the respective images for ascertaining transfer memory were the same 10,000, as the number of pixels per square placed in the image for ascertaining transfer memory becomes larger, the level of occurrence of the uneven density in the black halftone was worse. The reason will be described in the following.

Figure 9A:
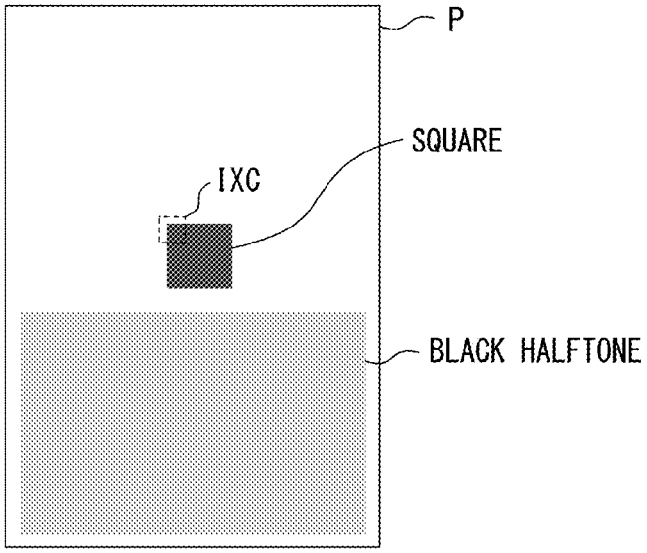
FIGS. 9A, 9B, and 9C are explanatory diagrams of images for ascertainment in Embodiment 3.
Figure 9B:
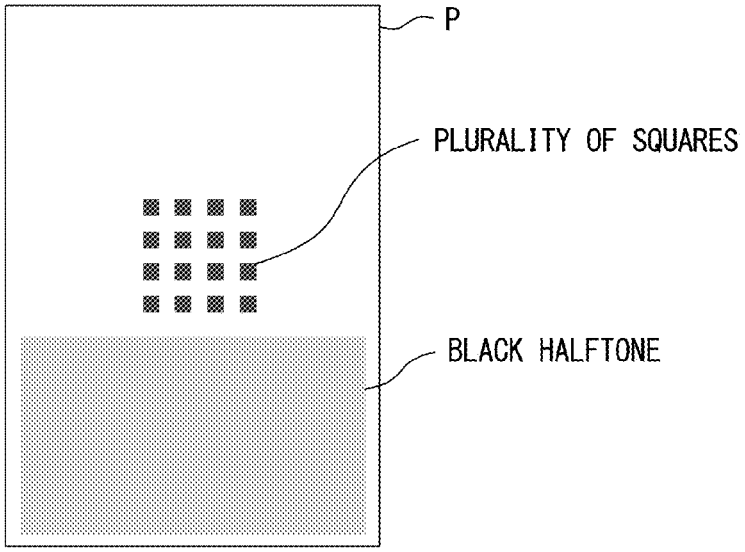
Figure 9C:
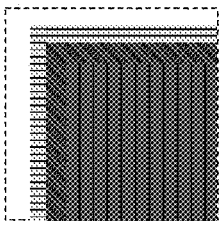

FIG. 9C is an enlarged view of a dotted section IXC in FIG. 9A, and illustrates an outermost peripheral section of the square in the image for ascertaining transfer memory. In FIG. 9C, a hatched line section denotes outermost peripheral pixels in the square, a vertical line section denotes pixels other than the outermost peripheral pixels in the square, and a horizontal line section denotes a solid white section near a border with the outermost peripheral pixels in the square. Transfer memory is caused because the amount of charge which transfers from the primary transfer member 21 to the photosensitive drum 11 in the primary transfer portion 2 is different between a high density section and a low density section of the toner image formed on the intermediate transfer belt 31.

In the high density section, transfer of charge from the primary transfer member 21 to the photosensitive drum 11 is suppressed by a toner layer, and thus, the amount of charge which transfers to the photosensitive drum 11 is small, and the surface potential of the photosensitive drum 11 is less liable to fluctuate. On the other hand, in the low density section, transfer of charge from the primary transfer member 21 to the photosensitive drum 11 is not suppressed by a toner layer, and thus, the amount of charge which transfers to the photosensitive drum 11 is large, and the surface potential of the photosensitive drum 11 is liable to fluctuate. Transfer memory is caused by the difference in fluctuation in the surface potential of the photosensitive drum 11 between the high density section and the low density section. However, in the vicinity of a border between the high density section and the low density section, charge which passes through the low density section flows into the high density section, and thus, even in the high density section, charge is liable to transfer from the primary transfer member 21 to the photosensitive drum 11, and the potential of the photosensitive drum 11 is liable to fluctuate. Therefore, in a high density section in the vicinity of a border with the low density section, transfer memory is less liable to occur. On the other hand, in a high density section other than the vicinity of a border with the low density section, charge does not flow thereinto from the low density section, and thus, transfer memory is liable to occur.

Based on the foregoing, the following can be said. In the outermost peripheral pixels (hatched line section) in the square which are in contact with the solid white section (horizontal line section) in FIG. 9C, transfer memory is less liable to occur. Pixels other than the outermost peripheral pixels (vertical line section) in the square are not in contact with the solid white section (horizontal line section), and thus, transfer memory is liable to occur therein. Therefore, it can be said that, as the total number of pixels other than the outermost peripheral pixels in the squares placed in the image for ascertaining transfer memory becomes larger, transfer memory is more liable to occur. As shown in FIG. 10, even though the total numbers of the pixels in the squares placed in the respective images for ascertaining transfer memory were the same, as the number of pixels per square placed in the image for ascertaining transfer memory becomes larger, the total number of pixels other than the outermost peripheral pixels in the squares placed in the image for ascertaining transfer memory becomes larger. As a result, as the number of pixels per square placed in the image for ascertaining transfer memory becomes larger, uneven density in the black halftone is more liable to occur.

As described above, it can be said that, even though the total number of pixels having the high density in the image is the same, as the total number of pixels having the high density adjacent to pixels having the high density as represented by the vertical line section in FIG. 9C becomes larger, transfer memory and halftone uneven density accompanying the transfer memory are more liable to occur. In other words, even though the total number of pixels having the high density in the image is the same, transfer memory is more liable to occur in a case in which pixels having the high density are dense in a part of the image such as a solid image than in a case in which pixels having the high density are scattered over the image such as a halftone image. Therefore, by using the total number of, among pixels having the high density in the image, pixels having the high density adjacent to pixels having the high density as in the embodiment, the possibility of occurrence of transfer memory which changes depending on the extent of denseness of pixels having the high density can be taken into consideration. As a result, the level of occurrence of transfer memory can be forecasted with more accuracy than by simply using the total number of pixels having the high density in the image as in Embodiment 2.

As shown in FIG. 10, in the embodiment, the total number of the image forming operations B performed in the image forming stations 1Y, 1M, 1C, and 1K when the images for ascertaining photosensitive drum deterioration were printed was 68. On the other hand, in Embodiment 2, the total number of the image forming operations B performed when the images for ascertaining photosensitive drum deterioration were printed was 113. Therefore, it can be seen that, by using the image forming sequence of the embodiment, the presence or absence of occurrence of transfer memory can be forecasted with more accuracy, and thus, deterioration of the photosensitive drum 11 can be further suppressed compared with the case of Embodiment 2.

To sum up the effect of the respective embodiments described above, according to the image forming apparatus disclosed in this application, halftone uneven density due to transfer memory can be suppressed and still deterioration of the photosensitive drum can be suppressed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-273731, filed Dec. 14, 2012, which is hereby incorporated by reference herein in its entirety.

What is claimed is:

1. An image forming apparatus, comprising:

a plurality of image forming stations; and a control portion configured to control an image forming operation, each of the plurality of image forming stations comprising:

an image bearing member configured to form a toner image on a surface thereof; and a charging device configured to charge the image bearing member, wherein respective toner images formed on image bearing members of the plurality of image forming stations are sequentially transferred to a transfer incurring member so as to be superimposed on top of each other, wherein the control portion sets a voltage applied to the charging device in forming an image in an image forming station among the plurality of image forming stations which performs a transfer later, based on image density information of the toner image transferred to the transfer incurring member by an image forming station among the plurality of image forming stations which performs a transfer earlier in a sequence of image forming operations, wherein the control portion sets the voltage applied to the charging device in forming the image in the image forming station among the plurality of image forming stations which performs the transfer later to a first set value when the image density information of the toner image transferred to the transfer incurring member by the image forming station among the plurality of image forming stations which performs the transfer earlier does not satisfy a predetermined density condition, and to a second set value when the image density information satisfies the predetermined density condition in the sequence of the image forming operations, and wherein an absolute value of the applied voltage in the second set value is greater than an absolute value of the applied voltage in the first set value.

2. An image forming apparatus according to claim 1, wherein the control portion determines that the predetermined density condition is satisfied when the toner image transferred to the transfer incurring member by the image forming station among the plurality of image forming stations which performs the transfer earlier includes a pixel having a predetermined density or higher.

3. An image forming apparatus according to claim 1, wherein the control portion determines that the predetermined density condition is satisfied when a total number of pixels having a predetermined density or higher included in the toner image transferred to the transfer incurring member by the image forming station among the plurality of image forming stations which performs the transfer earlier is equal to or greater than a predetermined number.

4. An image forming apparatus according to claim 1, wherein the control portion determines that the predetermined density condition is satisfied when a total number of pixels, among pixels in the toner image transferred to the transfer incurring member by the image forming station among the plurality of image forming stations which performs the transfer earlier, which have a predetermined density or higher and pixels adjacent to which also have the predetermined density or higher is equal to or greater than a predetermined number.

5. An image forming apparatus according to claim 1, further comprising an exposure device configured to expose the image bearing members to form latent images on the image bearing members, wherein each of the plurality of image forming stations further comprises a developing device configured to develop the latent image to form the toner image on the image bearing member.

6. An image forming apparatus according to claim 5, wherein the exposure device sets, by exposing an image section and a non-image section of the image bearing member charged by the charging device at different exposure intensities, surface potentials of the image section and the non-image section to a predetermined image section potential and a predetermined non-image section potential, respectively.

7. An image forming apparatus according to claim 5, wherein an exposure intensity of the exposure device which exposes the image bearing member is controlled in accordance with the voltage applied to the charging device configured to charge the image bearing member.

8. An image forming apparatus, comprising:

a plurality of image forming stations; and a control portion configured to control an image forming operation, each of the plurality of image forming stations comprising:

an image bearing member configured to form a toner image on a surface thereof; and a charging device configured to charge the image bearing member, the image forming apparatus further comprising an exposure device configured to expose an image section and a non-image section of the image bearing member charged by the charging device at different exposure intensities to set surface potentials of the image section and the non-image section to a predetermined image section potential and a predetermined non-image section potential, respectively, wherein respective toner images formed on image bearing members of the plurality of image forming stations are sequentially transferred to a transfer incurring member so as to be superimposed on top of each other, wherein the control portion sets a voltage applied to the charging device and the exposure intensities of the image section and the non-image section by the exposure device in forming an image in an image forming station among the plurality of image forming stations which performs a transfer later to first set values when image density information of the toner image transferred to the transfer incurring member by an image forming station among the plurality of image forming stations which performs a transfer earlier does not satisfy a predetermined density condition, and to second set values when the image density information satisfies the predetermined density condition in a sequence of image forming operations, and wherein exposure at the first set values excludes exposure of the non-image section.

9. An image forming apparatus according to claim 8, wherein an absolute value of a charged potential formed by the voltage of a second set value being applied to the charging device is larger than an absolute value of a charged potential formed by the voltage of a first set value being applied to the charging device.

10. An image forming apparatus according to claim 8, wherein the exposure intensities in the first set values and the exposure intensities in the second set values are set so that image section potentials formed by respective exposures have the same value and non-image section potentials formed by the respective exposures have the same value.

11. An image forming apparatus according to claim 8, wherein the control portion determines that the predetermined density condition is satisfied when the toner image transferred to the transfer incurring member by the image forming station among the plurality of image forming stations which performs the transfer earlier includes a pixel having a predetermined density or higher.

12. An image forming apparatus according to claim 8, wherein the control portion determines that the predetermined density condition is satisfied when a total number of pixels having a predetermined density or higher included in the toner image transferred to the transfer incurring member by the image forming station among the plurality of image forming stations which performs the transfer earlier is equal to or greater than a predetermined number.

13. An image forming apparatus according to claim 8, wherein the control portion determines that the predetermined density condition is satisfied when a total number of pixels, among pixels in the toner image transferred to the transfer incurring member by the image forming station among the plurality of image forming stations which performs the transfer earlier, which have a predetermined density or higher and pixels adjacent to which also have a predetermined density or higher is equal to or greater than a predetermined number.

14. An image forming apparatus according to claim 8, wherein each of the plurality of image forming stations further comprises a developing device configured to make toner adhere to the image section of the image bearing member to form the toner image.

* * * * *